US008702213B2

(12) United States Patent
Kobashi et al.

(10) Patent No.: US 8,702,213 B2
(45) Date of Patent: Apr. 22, 2014

(54) LIQUID HOLDING CONTAINER AND LIQUID CONSUMING APPARATUS

(71) Applicant: Seiko Epson Corporation, Tokyo (JP)

(72) Inventors: Masaru Kobashi, Matsumoto (JP); Yoichi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/750,563

(22) Filed: Jan. 25, 2013

(65) Prior Publication Data

US 2013/0187995 A1 Jul. 25, 2013

(30) Foreign Application Priority Data

Jan. 25, 2012 (JP) ..... 2012-012760

(51) Int. Cl.
*B41J 2/175* (2006.01)

(52) U.S. Cl.
USPC ..... 347/86; 347/85

(58) Field of Classification Search
USPC ..... 347/84, 85, 86, 87
See application file for complete search history.

(56) References Cited

U.S. PATENT DOCUMENTS

| | | | | |
|---|---|---|---|---|
| 5,764,259 | A * | 6/1998 | Nakajima | 347/86 |
| 6,969,161 | B2 * | 11/2005 | Kuwabara et al. | 347/85 |
| 7,175,264 | B2 | 2/2007 | Qingguo et al. | |
| 7,543,925 | B2 * | 6/2009 | Ishizawa et al. | 347/85 |
| 8,052,255 | B2 * | 11/2011 | Nishida | 347/85 |
| 2003/0076391 | A1 | 4/2003 | Wilson et al. | |

FOREIGN PATENT DOCUMENTS

JP 2003-127427 A 5/2003

* cited by examiner

*Primary Examiner* — Anh T. N. Vo
(74) *Attorney, Agent, or Firm* — Nutter McClennen & Fish LLP; John J. Penny, V

(57) ABSTRACT

In a liquid holding container configured so that a first liquid holding section in which a liquid outflow opening and an air intake opening are provided communicates with a second liquid holding section in which a liquid injection opening is provided, a divider member, capable of switching between a state in which the first liquid holding section and the second liquid holding section communicate and a state in which the stated sections are separated from each other in an airtight state, is provided in an area where the first liquid holding section and the second liquid holding section communicate with each other. If the first liquid holding section and the second liquid holding section are separated from each other in an airtight state, a negative pressure within the first liquid holding section can be maintained even if the injection opening is opened.

7 Claims, 7 Drawing Sheets

LIQUID HOLDING CONTAINER AND LIQUID CONSUMING APPARATUS

Priority is claimed under 35 U.S.C. §119 to Japanese Application No. 2012-012760 filed on Jan. 25, 2012 which is hereby incorporated by reference in its entirety.

BACKGROUND

1. Technical Field

The present invention relates to techniques for supplying a liquid to a liquid consuming apparatus.

2. Related Art

Liquid consuming apparatuses (for example, ink jet printers) that eject a liquid from an ejecting head are known. The liquid ejected from the ejecting head is held in a liquid holding container, and the liquid held in the liquid holding container is supplied to the ejecting head via a connection tube or the like.

The principle known as "Mariotte's bottle" is sometimes used for the purpose of supplying only the amount of liquid to be ejected from the liquid holding container to the ejecting head. With a liquid holding container using this principle, a liquid supply opening and an air intake opening are provided in a base area of the liquid holding container, the ejecting head is connected to the liquid supply opening via the connection tube, and the air intake opening communicates with the exterior via an air flow channel. The interior of the liquid holding container is at a negative pressure, and the structure is such that liquid attempting to flow out from the liquid supply opening (or the air intake opening) is held within the liquid holding container by the negative pressure.

In addition, a liquid holding container provided with an injection opening through which a liquid can be injected from the exterior is known (for example, JP-A-2003-127427). With this liquid holding container, when only a small amount of liquid remains in the interior, a cap that covers the injection opening is opened and the container is filled with liquid from the injection opening, making it possible to continually supply liquid to a liquid consuming apparatus.

However, a liquid holding container that utilizes the principle of Mariotte's bottle has a problem in that the liquid cannot be refilled by providing an injection opening. In other words, the negative pressure within the liquid holding container will be released if the injection opening is opened in order to refill the liquid, and there has thus been a problem in that the liquid cannot be held within the liquid holding container by utilizing the principle of Mariotte's bottle.

SUMMARY

It is an advantage of some aspects of the invention to provide a technique that makes it possible to refill a liquid even in a liquid holding container that utilizes the principle of Mariotte's bottle.

In order to solve at least some of the aforementioned problems, a liquid holding container according to the invention employs the following configuration. That is, the liquid holding container is a liquid holding container that supplies a liquid to a liquid consuming apparatus, and include: a first liquid holding section capable of holding a liquid therein; a liquid outflow opening through which the liquid flows from the first liquid holding section to the liquid consuming apparatus; an air intake opening, provided lower than the liquid surface of the liquid in the first liquid holding section, that is connected to an air flow channel that takes air into the first liquid holding section; a second liquid holding section that is capable of holding a liquid therein and that communicates with the first liquid holding section; an injection opening, provided in the second liquid holding section, that can be closed in an airtight state and opened in an opened state so as to allow the liquid to be injected; and a divider member, provided in an area where the first liquid holding section and the second liquid holding section communicate, that switches between a state in which the first liquid holding section and the second liquid holding section communicate and a state in which the first liquid holding section and the second liquid holding section are separated from each other in an airtight state.

In the liquid holding container according to the invention, the injection opening is sealed in an airtight state, and in this state, the liquid surface of the liquid attempts to drop under its own weight, creating a negative pressure in the interior; the liquid is held within the liquid holding container by this negative pressure. Meanwhile, two liquid holding sections (the first liquid holding section and the second liquid holding section) that communicate with each other are provided in the liquid holding container, and the divider member provided in the area where the two sections communicate with each other makes it possible to switch between a state in which the first liquid holding section and the second liquid holding section communicate with each other and a state in which the first liquid holding section and the second liquid holding section are separated from each other in an airtight state.

If the first liquid holding section and the second liquid holding section are separated from each other in an airtight state, the negative pressure within the first liquid holding section can be maintained even if the injection opening is opened. Accordingly, if the liquid is injected into the second liquid holding section from the injection opening and the first liquid holding section and the second liquid holding section are put into a communicative state after the injection opening is closed in an airtight state, the liquid holding container can be refilled with the liquid while maintaining the negative pressure.

In addition, in the liquid holding container according to the invention, it is preferable that the first liquid holding section communicate with the second liquid holding section in a plurality of locations whose positions are different relative to the liquid surface of the liquid in the first liquid holding section, and the divider member be provided for each location where the first liquid holding section and the second liquid holding section communicate with each other.

In this case, when the divider member is opened and first liquid holding section and the second liquid holding section are caused to communicate after the second liquid holding section has been filled with the liquid, the liquid that flows from the second liquid holding section to the first liquid holding section and the liquid that flows from the first liquid holding section to the second liquid holding section move through separate channels. Accordingly, the movement of the liquid is not inhibited by the movement of air, and thus the liquid can move quickly; as a result, the refilling of the liquid holding container with the liquid can be completed quickly. In addition, because the channel through which air moves and the channel through which the liquid moves are separate, it is difficult for air to intermix with the moving liquid. As a result, the occurrence of issues caused by bubbles in the liquid can be suppressed.

Furthermore, it is preferable that the invention be implemented as a liquid consuming apparatus that includes the aforementioned liquid holding container according to the invention. With the liquid consuming apparatus according to the invention, even a liquid holding container that utilizes the principle of Mariotte's bottle can be filled with a liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described according to the following order in order to clarify the content of the invention.

Apparatus Configuration
Method for Filling Ink Tank with Ink
Variations
First Variation
Second Variation
Third Variation

Apparatus Configuration

Figure 1:
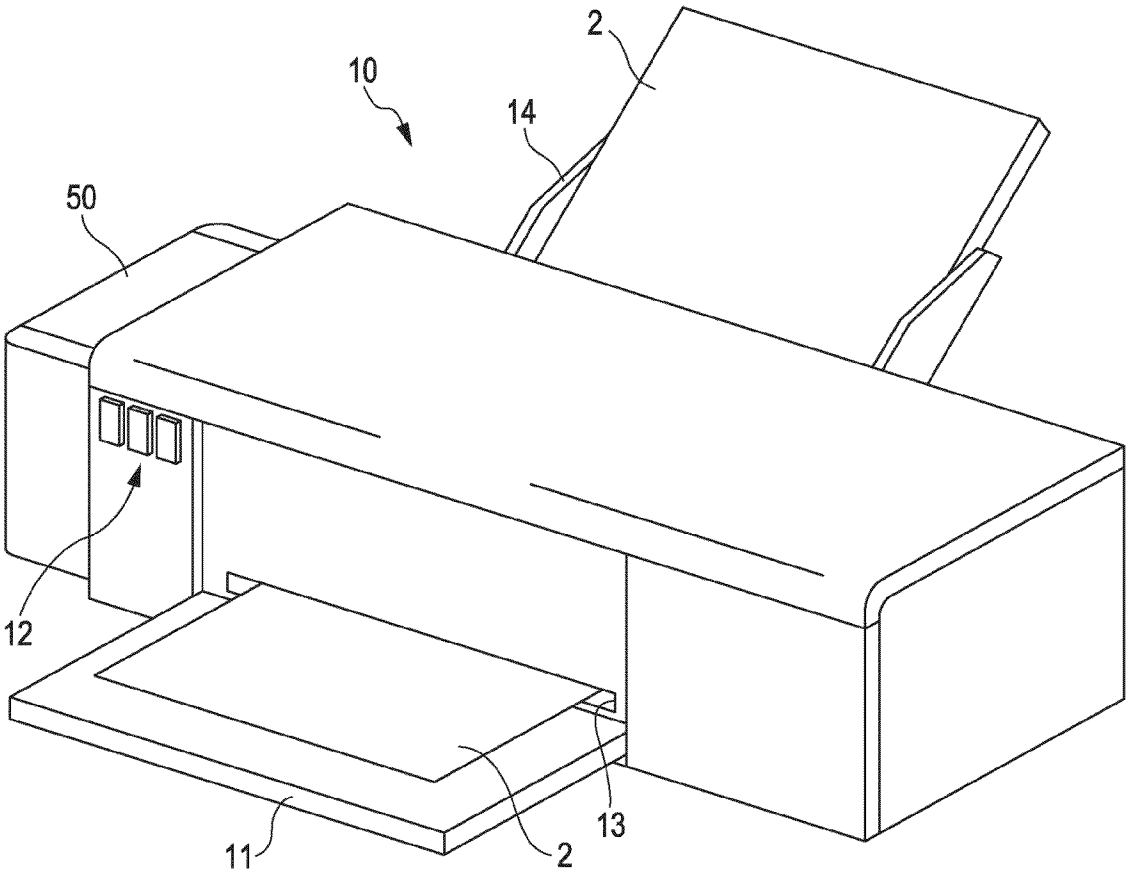
FIG. 1 is a schematic diagram illustrating the general configuration of a liquid consuming apparatus according to an embodiment, using what is known as an ink jet printer as an example.

FIG. 1 is a schematic diagram illustrating the general configuration of a liquid consuming apparatus according to this embodiment, using what is known as an ink jet printer as an example. An ink jet printer 10 has an approximately box-shaped outer shape; a front cover 11 is provided in essentially the center of the front surface of the printer, and a plurality of operation buttons 12 are provided to the left thereof. The front cover 11 is axially supported on its lower end, and a long, thin paper discharge port 13 from which print paper 2 is discharged is exposed when the upper end of the front cover 11 is tilted forward. In addition, a paper supply tray 14 is provided on the rear surface side of the ink jet printer 10, and when the print paper 2 is set in the paper supply tray 14 and the operation buttons 12 are operated, the print paper 2 is fed from the paper supply tray 14, after which an image or the like is printed on the print paper 2 within the ink jet printer 10 and the print paper 2 is discharged from the paper discharge port 13.

In addition, a box-shaped tank case 50 is provided on a side surface of the ink jet printer 10. Although details will be given later, a plurality of ink tanks (liquid holding containers) are provided within the tank case 50, and the ink used by the ink jet printer 10 to print is supplied from these ink tanks.

Figure 2:
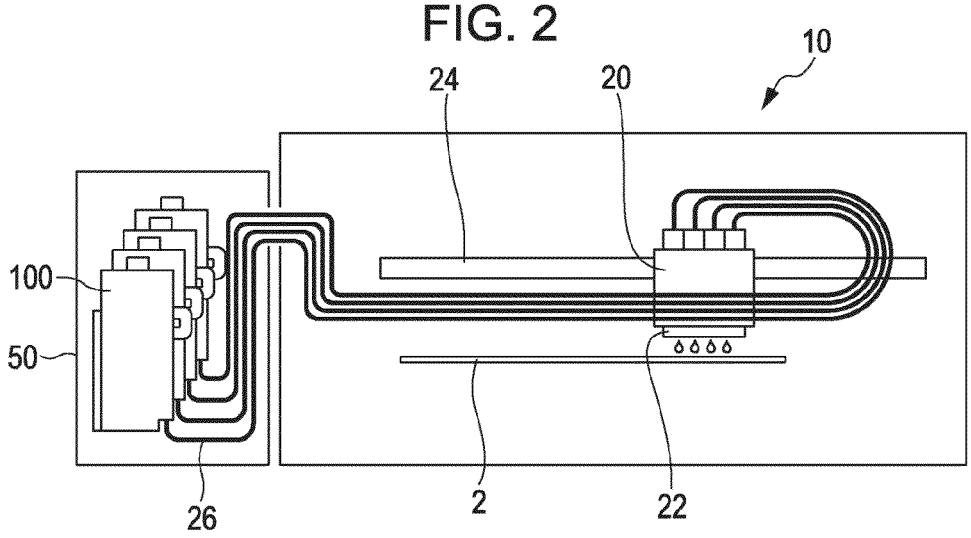
FIG. 2 is a schematic diagram illustrating the internal structure of an ink jet printer.

FIG. 2 is a schematic diagram illustrating the internal structure of the ink jet printer 10. As shown in FIG. 2, a carriage 20 that moves back and forth above the print paper 2 is provided within the ink jet printer 10. An ejecting head 22 in which a plurality of ejecting nozzles are formed is mounted on the base surface side (that is, the side that faces the print paper 2) of the carriage 20, and ink is ejected from the ejecting nozzles toward the print paper 2. In the ink jet printer 10 according to this embodiment, a color image can be printed using four types of ink, or cyan, magenta, yellow, and black, and in accordance therewith, an ejecting nozzle is provided in the ejecting head 22 of the carriage 20 for each type of ink.

The carriage 20 is driven by a driving mechanism (not shown) and moves repeatedly back and forth above the print paper 2 while being guided by a guide rail 24. In addition, a paper feed mechanism (not shown) is also provided in the ink jet printer 10, and the print paper 2 is fed by a small amount at a time in tandem with the back-and-forth movement of the carriage 20. An image or the like is printed on the print paper 2 by ejecting ink from the ejecting nozzles in the ejecting head 22 as the carriage 20 moves back and forth and the print paper 2 is fed.

The ink ejected from the ejecting nozzles is held in ink tanks 100 within the tank case 50. Because the ink jet printer 10 according to this embodiment uses the four types of ink, or cyan, magenta, yellow, and black, the ink tanks 100 are also provided for each type of ink. The ink within the ink tanks 100 is supplied to the ejecting head 22 via ink tubes 26 provided for each type of ink.

Figure 3:
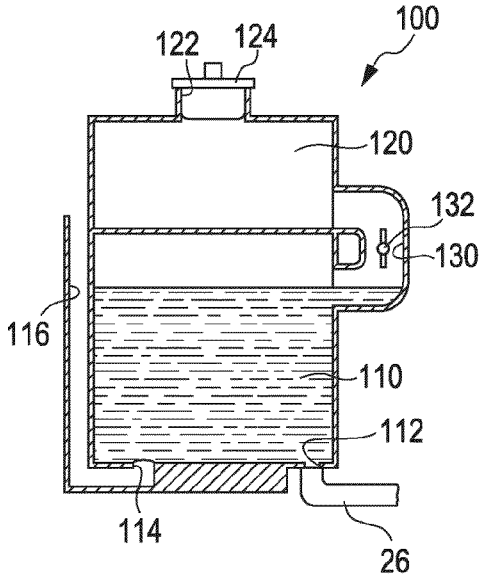
FIG. 3 is a cross-sectional view illustrating the configuration of an ink tank according to an embodiment.

FIG. 3 is a cross-sectional view illustrating the configuration of the ink tanks 100 according to this embodiment. As shown in FIG. 3, the interior of the ink tank 100 is divided into top and bottom sections by a partition wall, forming a first ink holding section 110 on the bottom side and a second ink holding section 120 on the top side. The first ink holding section 110 and the second ink holding section 120 are connected by a communication channel 130. Note that the first ink holding section 110 according to this embodiment corresponds to a first liquid holding section according to the invention, and the second ink holding section 120 according to this embodiment corresponds to a second liquid holding section according to the invention.

An ink supply opening 112 (liquid outflow opening) is provided in the base area of the first ink holding section 110, on the right side thereof, and the ink supply opening 112 is connected to the ink tube 26. Meanwhile, an air intake opening 114 is provided in the base area of the first ink holding section 110, on the left side thereof, and the air intake opening 114 communicates with the exterior of the ink tank 100 (that is, the atmosphere) via an air flow channel 116.

An injection opening 122 for refilling ink is provided in an upper area of the second ink holding section 120, and the injection opening 122 is covered by a cap 124. Meanwhile, an on/off valve 132 (a divider member), capable of separating the first ink holding section 110 and the second ink holding section 120 in an airtight state by closing off the communication channel 130, is provided partway along the communication channel 130. Although the volume of the second ink holding section 120 is set to be lower than the volume of the first ink holding section 110 in the ink tank 100 shown in FIG. 3, it should be noted that the volume of the second ink holding section 120 may be set to be higher than the volume of the first ink holding section 110.

With the ink tank 100 configured as described above, ink is supplied to the ejecting head 22 in the following manner. First, the interior of the ink tank 100 is sealed in a state in which the injection opening 122 is covered by the cap 124; in this state, the liquid surface of the ink attempts to drop under its own weight, and thus the interior of the ink tank 100 has a negative pressure. Accordingly, the ink is held within the first ink holding section 110 by this negative pressure. Then, when ink is sucked from the ink supply opening 112 by the ejecting head 22, the negative pressure within the ink tank 100 increases, and as a result, an amount of air equivalent to the amount of ink sucked to the ejecting head 22 is supplied to the interior of the ink tank 100 from the air intake opening 114. In this manner, once the ink tank 100 has been installed in the ink jet printer 10, the interior of the ink tank 100 is always in a state of negative pressure.

Method for Filling Ink Tank with Ink

Figure 4A:
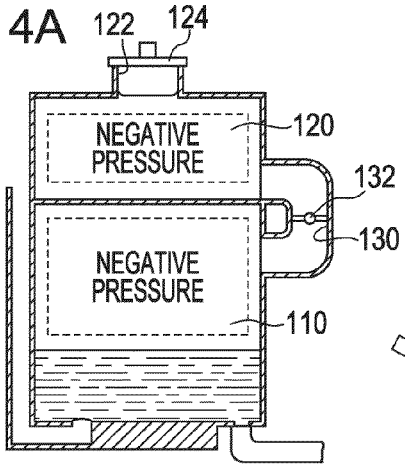
FIGS. 4A through 4E are schematic diagrams illustrating a method for filling an ink tank with ink according to an embodiment.
Figure 4B:
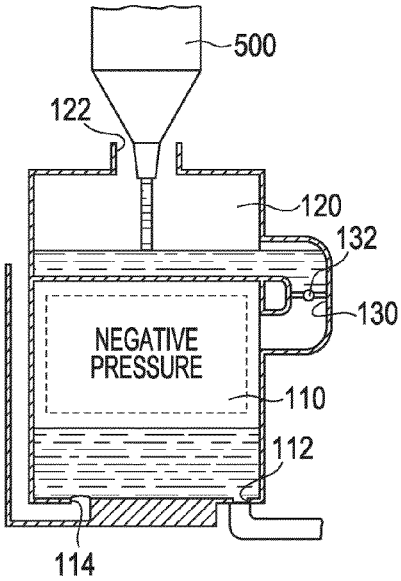

FIGS. 4A through 4E are schematic diagrams illustrating a method for filling the ink tank 100 with ink according to this embodiment. When filling the ink tank 100 with ink, first, as shown in FIG. 4A, the on/off valve 132 in the communication channel 130 is closed, after which the cap 124 is opened, as shown in FIG. 4B; then, ink from an ink bottle 500 is injected into the second ink holding section 120 from the injection opening 122. At this time, the second ink holding section 120 loses its sealed state and the negative pressure therein is released. However, because the communication channel 130 is closed off, the first ink holding section 110 remains in a sealed state, and the negative pressure therein is maintained.

Figure 4C:
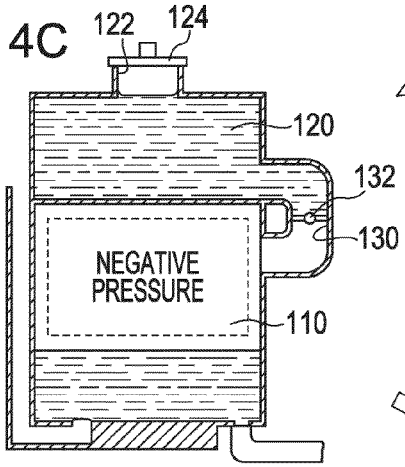
Figure 4D:
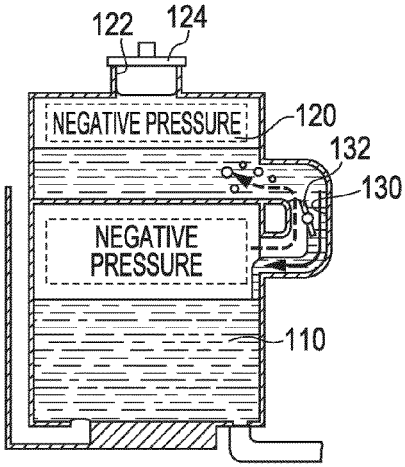
Figure 4E:
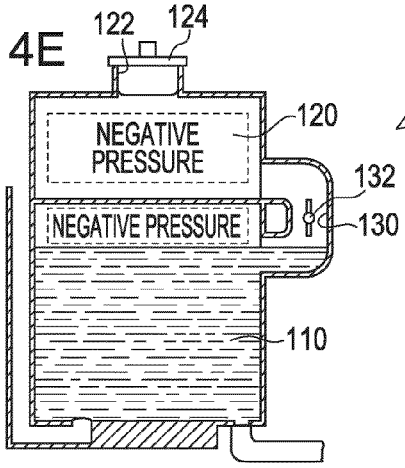

Once the second ink holding section 120 has been filled with ink, the cap 124 is replaced and the ink tank 100 is sealed, as shown in FIG. 4C, after which the on/off valve 132 is opened. Upon doing so, as shown in FIG. 4D, the ink within the second ink holding section 120 flows into the first ink holding section 110 via the communication channel 130 and the air within the first ink holding section 110 moves to the second ink holding section 120 via the communication channel 130. As a result, as shown in FIG. 4E, all of the ink that was injected into the second ink holding section 120 moves into the first ink holding section 110. The interior of the ink tank 100 is kept in a sealed state while the ink moves in this manner, and thus the negative pressure within the first ink holding section 110 and the second ink holding section 120 is maintained.

In this manner, with the ink tank 100 according to this embodiment, the negative pressure in the ink tank 100 is not released even if the cap 124 is opened. Accordingly, even though the ink tank 100 requires its interior to be kept at a negative pressure to be maintained in order to hold the ink, it is still possible to refill the ink.

Variations

Many variations can be made on the ink tank 100 according to the embodiment described above. Such variations will be described briefly hereinafter. Note that the following variations will focus on areas that differ from the ink tank 100 according to the aforementioned embodiment; configurations that are the same as in ink tank 100 according to the aforementioned embodiment will be given the same reference numerals, and descriptions thereof will be omitted.

First Variation

In the ink tank 100 according to the aforementioned embodiment, the ink is moved from the second ink holding section 120 to the first ink holding section 110 and air is moved from the first ink holding section 110 to the second ink holding section 120 using a single communication channel 130. However, two communication channels that enable the second ink holding section 120 and the first ink holding section 110 to communicate may be provided.

Figure 5A:
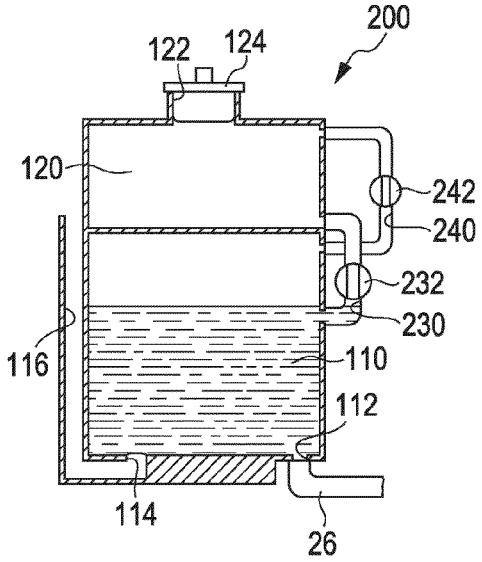
FIGS. 5A through 5C are cross-sectional views illustrating the configuration of an ink tank according to a first variation.
Figure 5B:
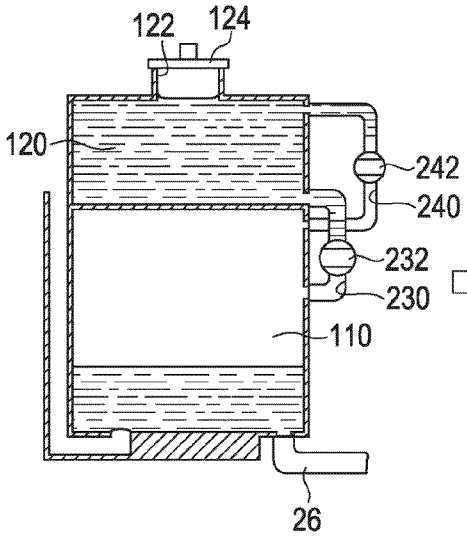
Figure 5C:
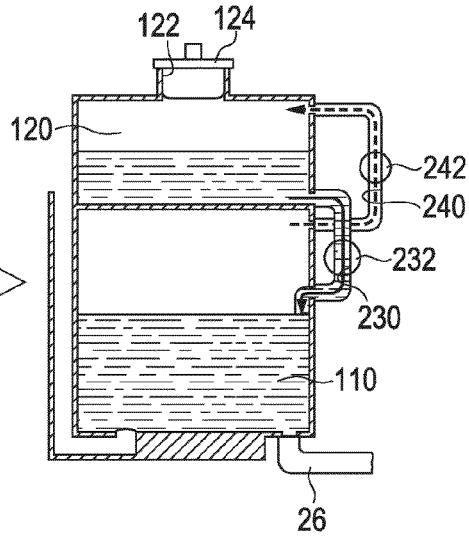

FIGS. 5A through 5C are cross-sectional views illustrating the configuration of an ink tank 200 according to a first variation. As shown in FIG. 5A, a first communication channel 230 that connects the first ink holding section 110 to a lower area of the second ink holding section 120, and a second communication channel 240 that connects upper areas of the first ink holding section 110 and the second ink holding section 120, are provided in the ink tank 200. Meanwhile, on/off valves 232 and 234 are provided partway along the first communication channel 230 and the second communication channel 240, respectively, and the first ink holding section 110 and the second ink holding section 120 can be separated from each other in an airtight state by closing the on/off valves 232 and 234.

With the ink tank 200 according to the first variation, when the on/off valves 232 and 234 are opened while the second ink holding section 120 is filled with ink (see FIG. 5B), the ink in the second ink holding section 120 flows into the first ink holding section 110 via the first communication channel 230 and the air within the first ink holding section 110 moves into the second ink holding section 120 via the second communication channel 240, as shown in FIG. 5C. In this manner, by dividing the channel into a channel through which ink moves (the first communication channel 230) and a channel through which air moves (the second communication channel 240), the exchange of ink and air between the first ink holding section 110 and the second ink holding section 120 can be expedited, making it possible to quickly move the ink into the first ink holding section 110.

In addition, because the channel through which air moves and the channel through which ink moves are separate, it is difficult for air to intermix with the moving ink. As a result, it is possible to suppress the occurrence of issues such as ejection problems caused by bubbles being produced within the ink.

Second Variation

In the ink tanks 100 and 200 according to the aforementioned embodiment and first variation, respectively, the first ink holding section 110 and the second ink holding section 120 communicate via communication channels. However, the first ink holding section and the second ink holding section may be caused to communicate using the following configuration.

Figure 6A:
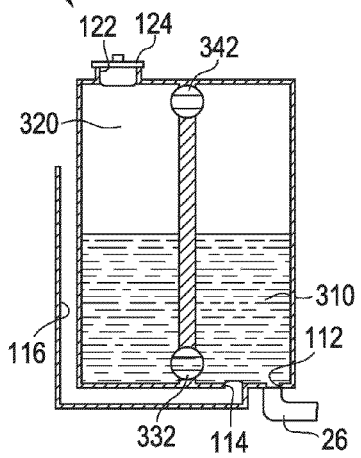
FIGS. 6A and 6B are cross-sectional views illustrating the configuration of an ink tank according to a second variation.
Figure 6B:
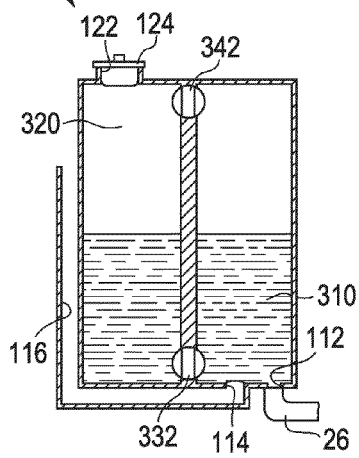

FIGS. 6A and 6B are cross-sectional views illustrating the configuration of an ink tank 300 according to a second variation. As shown in FIG. 6A, the ink tank 300 is divided into left and right interior sections by a partition wall; the section on the right side serves as a first ink holding section 310, whereas the section on the left side serves as a second ink holding section 320. The first ink holding section 310 and the second ink holding section 320 communicate via through-hole sections formed in two locations, at the top and bottom of the partition wall; air can be moved through the through-hole section provided at the top, whereas ink can be moved through the through-hole section provided in the bottom. In addition, on/off valves 342 and 332 are provided in the through-hole sections of the top and bottom, and the first ink holding section 310 and the second ink holding section 320 can be separated from each other in an airtight state by closing the on/off valves 342 and 332 (see FIG. 6B).

Even with such a configuration, the first ink holding section 310 and the second ink holding section 320 can be closed off from communicating with each other, and thus the negative pressure within the first ink holding section 310 can be maintained with the cap 124 in an open state. Accordingly, the ink can be held within the first ink holding section, and thus the ink tank 300 can be refilled with ink in the same manner as in the case where the first ink holding section 110 and the second ink holding section 120 are connected via a communication channel.

Third Variation

With the ink tanks 100, 200, and 300 according to the aforementioned embodiment and variations, the first ink holding section and the second ink holding section are described as being divided by a partition wall. Here, if the partition wall is implemented as a partition plate that can rotate, as described below, rotating the partition plate makes it possible to switch between a state in which the first ink holding section and the second ink holding section communicate, and a state in which the first ink holding section is sealed.

Figure 7A:
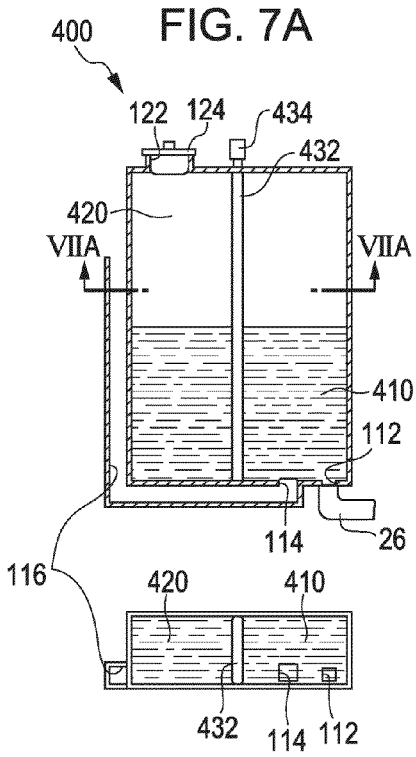
FIGS. 7A and 7B are cross-sectional views illustrating the configuration of an ink tank according to a third variation.
Figure 7B:
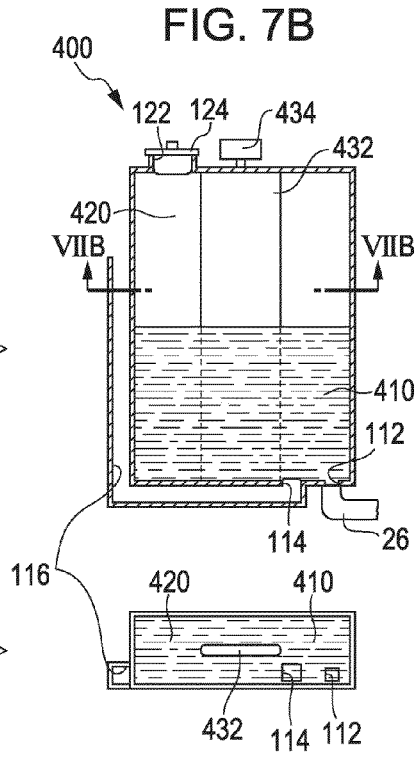

FIGS. 7A and 7B are cross-sectional views illustrating the configuration of an ink tank 400 according to a third variation. The upper sections of FIGS. 7A and 7B are vertical cross-sectional views of the ink tank 400, and below the vertical cross-sectional views, horizontal cross-sectional views of the ink tank 400 taken from above the VIIA-VIIA and VIIB-VIIB cross-sections in the vertical cross-sectional views are illustrated.

As shown in FIG. 7A, in the ink tank 400 according to the third variation, a first ink holding section 410 on the right side and a second ink holding section 420 on the left side are divided by a partition plate 432. A rotation shaft provided at the upper end of the partition plate 432 protrudes to the outside of the ink tank 400, and a tab 434 is attached to the rotation shaft. With the ink tank 400 configured in this manner, rotating the tab 434 on the partition plate 432 makes it possible to switch between a state in which the first ink holding section 410 and the second ink holding section 420 are separated from each other in an airtight state (the state shown in FIG. 7A) and a state in which the first ink holding section 410 and the second ink holding section 420 communicate with each other (the state shown in FIG. 7B). Accordingly, the ink tank 400 can be refilled with ink in the same manner as the ink tanks 100, 200, and 300 according to the aforementioned embodiment and variations.

Figure 8:
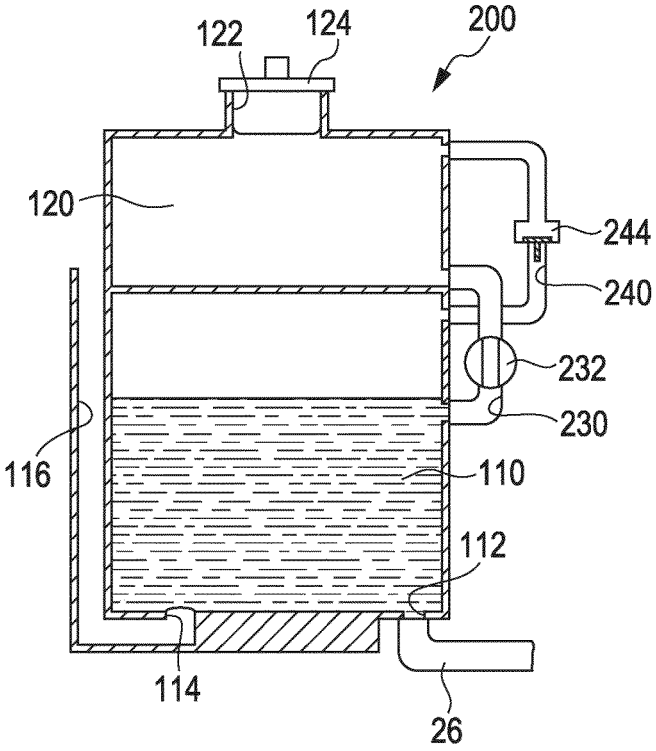
FIG. 8 is a schematic diagram illustrating an ink tank in which a check valve is provided in a second communication channel instead of an on/off valve.

Although various embodiments have been described above, the invention is not limited to all of the aforementioned embodiments, and the invention can be embodied in various other forms without departing from the essential spirit thereof. For example, the ink tank 200 according to the aforementioned first variation is described as having an on/off valve 242 provided in the second communication channel 240 that allows air to move between the first ink holding section 110 and the second ink holding section 120 (see FIGS. 5A through 5C). However, a check valve 244 may be provided in the second communication channel 240 instead of the on/off valve 242, as shown in FIG. 8. In such a case, the check valve 244 opens automatically only when air moves from the first ink holding section 110 to the second ink holding section 120, and is closed at all other times, making it possible to remove the burden of opening and closing the on/off valve in the second communication channel 240.

What is claimed is:

1. A liquid holding container that supplies a liquid to a liquid consuming apparatus, the container comprising:

a first liquid holding section capable of holding a liquid therein;

a liquid outflow opening through which the liquid flows from the first liquid holding section to the liquid consuming apparatus;

an air intake opening, provided lower than the liquid surface of the liquid in the first liquid holding section, that is connected to an air flow channel that takes air into the first liquid holding section;

a second liquid holding section that is capable of holding a liquid therein and that communicates with the first liquid holding section;

an injection opening, provided in the second liquid holding section, that can be closed in an airtight state and opened in an opened state so as to allow the liquid to be injected; and a divider member, provided in an area where the first liquid holding section and the second liquid holding section communicate, that switches between a first state in which the first liquid holding section and the second liquid holding section communicate and a second state in which the first liquid holding section and the second liquid holding section are separated from each other in an airtight state, wherein when the liquid flows from the first liquid holding section to the liquid consuming apparatus, the injection opening is sealed in the airtight state.

2. The liquid holding container according to claim 1, wherein the first liquid holding section communicates with the second liquid holding section in a plurality of locations whose positions are different relative to the liquid surface of the liquid in the first liquid holding section; and the divider member is provided for each location where the first liquid holding section and the second liquid holding section communicate with each other.

3. A liquid consuming apparatus comprising the liquid holding container according to claim 2.

4. A liquid consuming apparatus comprising the liquid holding container according to claim 1.

5. The liquid holding container according to claim 1, wherein after the divider member is closed, the injection opening is opened when filling the second liquid holding section with the liquid.

6. The liquid holding container according to claim 5, wherein the injection opening is closed after the second liquid holding section is filled with the liquid, after which the divider member is switched to the first state.

7. The liquid holding container according to claim 1, wherein the injection opening is closed after the second liquid holding section is filled with the liquid, after which the divider member is switched to the first state.

* * * * *